US006172592B1

(12) United States Patent
Inoue et al.

(10) Patent No.: US 6,172,592 B1
(45) **Date of Patent: *Jan. 9, 2001**

(54) THERMISTOR WITH COMB-SHAPED ELECTRODES

(75) Inventors: Hidehiro Inoue; Mitsuaki Fujimoto; Yuichi Takaoka, all of Shiga (JP)

(73) Assignee: Murata Manufacturing Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/170,897

(22) Filed: Oct. 13, 1998

(30) Foreign Application Priority Data

Oct. 24, 1997 (JP) ..... 9-292936
Oct. 24, 1997 (JP) ..... 9-292937

(51) Int. Cl.[7] ..... H01C 7/10
(52) U.S. Cl. ..... 338/22 R; 338/313; 338/332
(58) Field of Search ..... 338/22 R, 225 D, 338/313, 332

(56) References Cited

U.S. PATENT DOCUMENTS 3,885,129 * 5/1975 Fabricius ..... 219/553
4,034,207 * 7/1977 Tamada et al. ..... 219/517
4,037,082 * 7/1977 Tamada et al. ..... 219/541
4,649,364 * 3/1987 Tanahashi et al. ..... 338/14
5,015,986 * 5/1991 Uchida et al. ..... 338/22 R
5,534,843 * 7/1996 Tsunoda et al. ..... 338/22 R

FOREIGN PATENT DOCUMENTS

5135914 * 6/1993 (JP) ..... 338/22 SD
645108 * 2/1994 (JP) ..... 338/22 R
6-061011 3/1994 (JP) .
9-260108 10/1997 (JP) .
9016074 * 12/1990 (WO) ..... 338/22 R

* cited by examiner

*Primary Examiner*—Karl D. Easthom
(74) *Attorney, Agent, or Firm*—Majestic, Parsons, Siebert & Hsue P.C.

(57) ABSTRACT

A chip-type thermistor has a pair of electrically conductive planar comb-shaped surface electrodes facing each other on one of principal surfaces of a thermistor block, and an insulating layer covers these surface electrodes. A pair of outer electrodes are formed on end surfaces of the thermistor block, each electrically connected to an associated one of the surface electrodes.

10 Claims, 10 Drawing Sheets

FIG._18B-a
(PRIOR ART)

THERMISTOR WITH COMB-SHAPED ELECTRODES

BACKGROUND OF THE INVENTION

This invention relates to thermistors inclusive of chip-type thermistors (or "chip thermistors") of the kind which are commonly used in a temperature-compensating circuit or a temperature detecting element. More particularly, this invention relates to such thermistors having a pair of surface electrodes formed on one surface of a thermistor block so as to face each other.

Chip-type thermistors using semiconductor ceramics having a positive or negative temperature coefficient have been widely in use, and those with many different structures have been considered so as to be easily surface-mountable to a printed circuit board. The structure of some of prior art chip-type thermistors will be described first with reference to FIGS. 16–19.

FIG. 16 shows a prior art chip-type thermistor 71 with a pair of external electrodes 73*a* and 73*b* formed so as to cover both end surfaces 72*a* and 72*b* of a thermistor-forming base body (hereinafter referred to as the "thermistor block") 72 of a semiconductor ceramic material. The resistance of the thermistor 71 is determined not only by the resistance of the thermistor block 72 but also the contact areas of the external electrodes 73*a* and 73*b* with the thermistor block 72. The external electrodes 73*a* and 73*b* are usually formed by a dipping method, but this method tends to result in large variations in the lengths of the parts of the electrodes 73*a* and 73*b* covering the upper, lower and side surfaces of the thermistor block 72. Since there are variations also in the specific resistance of the thermistor blocks, the overall variations in the resistance of thermistors 71 thus produced are large, and it has been difficult to produce thermistors with a desired resistance value.

In view of the above, thermistors as shown in FIG. 17 at 75 came to be proposed, having glass layers 74 formed over the top, bottom and both side surfaces of a thermistor block 72. Since the external electrodes 73*a* and 73*b* contact the thermistor block 72 only through the end surfaces 72*a* and 72*b* of the latter, the resistance of the thermistor 75 is determined only by the resistance of the thermistor block 72 itself and the area of its end surfaces 72*a* and 72*b*. Thus, the variations in the resistance values of the thermistors can be reduced.

If the external electrodes 73*a* and 73*b* are formed by coating a conductive paste and subjecting it to a firing process, however, the materials of the glass layers 74 and the external electrodes 73*a* and 73*b* tend to diffuse into each other where they contact each other. If a portion of the glass layer 74 falls off as a result of such diffusion, as shown in the enlarged portion of FIG. 17 enclosed in a circle A, the outer electrode 73*b* may come to contact the thermistor block 72 directly. Since it is difficult to prevent such a diffusion phenomenon, there still remained the problem of obtaining thermistors with a desired resistance value.

Moreover, the variations in the resistance value of the thermistor blocks 72 have remained large, making it very difficult to obtain thermistors with highly accurate resistance values.

When thermistors 75 with different specified resistance values are to be produced, furthermore, thermistor blocks with different specific resistance values are required. It was thus even more difficult to accurately produce thermistors with different resistance values.

There have also been proposals to produce thermistors as shown at 77 in FIGS. 18A and 18B with inner electrodes 76*a* and 76*b* formed inside the thermistor block 72. In the example shown in FIGS. 18A and 18B, the two inner electrodes 76*a* and 76*b* are positioned in a face-to-face relationship with each other within a same plane at a specified height inside the thermistor block 72, one of the inner electrodes (76*a*) being connected to one of the external electrodes (73*a*) and the other inner electrode 76*b* being connected to the other external electrode 73*b*.

Such thermistors 77 are produced by a known kind of ceramic layering technology, the inner electrodes 76*a* and 76*b* being formed by applying a conductive paste on a ceramic green sheet by a screen printing method. Thus, the gap between the two inner electrodes 76*a* and 76*b* can be varied easily, even when thermistor blocks 72 of a same size are used, by adjusting the interval between the printed areas at the time of screen printing. In other words, thermistors 77 with different resistance values can be obtained fairly easily.

When the conductive paste is applied in a printing process as described above, however, the inwardly facing edges of the inner electrodes 76*a* and 76*b* are sometimes blurred and deformed, as shown enlarged in the elliptically marked portion indicated by arrow B of FIG. 18B. Since several ceramic green sheets are subjected to a firing process together after a conductive paste is printed thereon and they are piled up one top of another, furthermore, variations in the shrinkage accompanying the firing process also contribute to variations in the shapes of the inner electrodes 76*a* and 76*b*. As a result, it was also difficult to produce thermistors of this kind with inner electrodes accurately having a desired resistance value.

FIGS. 19A and 19B show a chip-type thermistor 78 disclosed in Japanese Patent Publication Tokkai 6-61011, intended to reduce variations in the resistance value, characterized as having a pair of rectangular surface electrodes 79*a* and 79*b* formed on the upper surface of a thermistor block 72 in a face-to-face relationship with respect to each other with a gap of a specified width in between. Outer electrodes 73*a* and 73*b*, as described above, are formed so as to cover portions of these surface electrodes 79*a* and 79*b* on the upper surface of the thermistor block 72. An insulating layer is formed additionally on the top surface of the thermistor block 72 so as to cover mutually facing edge portions of the surface electrodes 79*a* and 79*b*, as well as the portion of the top surface of the thermistor block 72 not covered by the surface electrodes 79*a* and 79*b*. These surface electrodes 79*a* and 79*b* can be formed accurately because the thin film technology can be used for this purpose. The requirement that the electrodes 79*a* and 79*b* must be rectangular is a drawback, however, when it is desired to produce chip-type thermistors with a very small resistance value because the separation between these surface electrodes 79*a* and 79*b* must be increased and this makes it necessary to use a larger thermistor block 72.

SUMMARY OF THE INVENTION

It is therefore an object of this invention to provide chip-type thermistors with small variations in their resistance values.

It is another object of this invention to provide such thermistors with small resistance values.

A chip-type thermistor embodying this invention, with which the above and other objects can be accomplished, may be characterized as having a pair of electrically conductive planar surface electrodes, at least one of which is comb-shaped, facing each other on one of principal surfaces of a thermistor block, an insulating layer being formed on the same surface of the thermistor block so as to cover these surface electrodes, and a pair of outer electrodes formed on end surfaces of the thermistor block so as to be each electrically connected to an associated one of the surface electrodes. Both of the pair of these surface electrodes may be comb-shaped, and the thickness of these surface electrodes is preferably 0.1–2 $\mu$m. A similar pair of surface electrodes may also be present on the other of the principal surfaces of the thermistor block, and the insulating layer preferably extends to edges between the principal surface and the end surfaces of the thermistor block.

The resistance value of such a chip-type thermistor is adjusted according to this invention by removing at least a portion of its surface electrodes, such as a portion of one of the electrode fingers, until its resistance comes within a specified range of its target value. For such removal of a portion or portions of a surface electrode, a method of laser trimming, sand-blasting or etching may be used. Chip-type thermistors characterized as having thus been adjusted are also intended to embody this invention.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like or equivalent components are indicated by the same numerals even where they are components of different devices and may not necessarily be described repetitiously.

DETAILED DESCRIPTION OF THE INVENTION

Figure 1A:
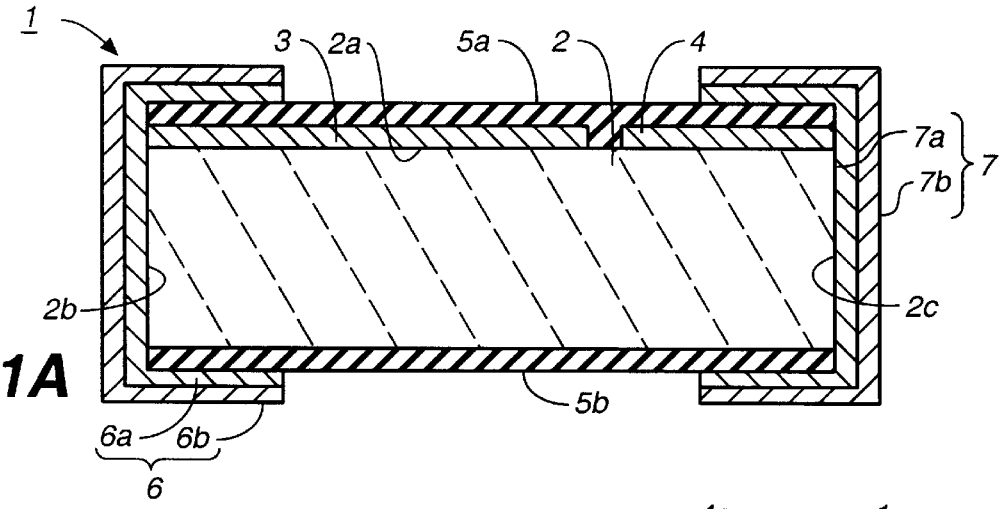
FIGS. 1A and 1B are respectively a sectional side view and a plan view of a chip-type thermistor according to a first embodiment of this invention.
Figure 1B:
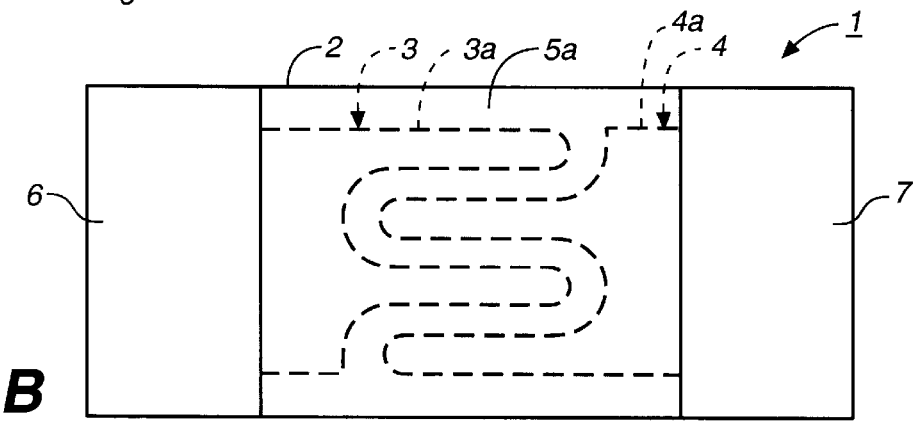

FIGS. 1A and 1B show a chip-type thermistor 1 according to a first embodiment of this invention having a base body (herein referred to as the "thermistor block") 2 of a semiconductor ceramic material with either a positive or negative temperature coefficient for its resistance. As shown by broken lines in FIG. 1B, comb-shaped surface electrodes 3 and 4 each having a plurality of mutually parallel protruding members (herein referred to as "the electrode fingers") 3*a* and 4*a* are formed on the upper surface 2*a* of the thermistor block 2. The electrode fingers 3*a* or 4*a* from each of the electrodes 3 and 4 are inserted and sandwiched between the electrode fingers 4*a* or 3*a* from the other of the electrodes 3 and 4 in an interdigital formation such that the mutually facing distance of the surface electrodes 3 and 4 (defined qualitatively as the distance along the portion of the contour of the comb-shaped electrodes where the two electrodes are separated only by a small gap between their finger electrodes) are greater than their width. The surface electrodes 3 and 4 may comprise an appropriate metallic material such as a Ni/Cr alloy or Ag or may be of a layered structure with two or more layers. They are preferably formed by a method of the thin film technology such as vapor deposition, sputtering or electroplating such that they can have accurate shapes.

An insulating layer 5*a* is formed, covering the surface electrodes 3 and 4. Another insulating layer 5*b* covers the bottom surface of the thermistor block 2. These insulating layers 5*a* and 5*b* may comprise a heat-resistant resin such as polyimide. By the heat-resistant resin is meant a resin which is capable of withstanding a temperature of 150° C., or of which the temperature of thermal deformation according to the ASTM method (D648) is over 150° C. It is preferable to form these insulating layers 5*a* and 5*b* by a spin coating method such that they can be formed with a uniform thickness.

Mutually separated outer electrodes 6 and 7 are formed on the end surfaces 2*b* and 2*c* of the thermistor block 2, each being of a layered structure with an underlying layer 6*a* or 7*a* and an outer layer 6*b* or 7*b*. As shown in FIGS. 1A and 1B, each of these outer electrodes 6 and 7 has a center part, an upper end part and a lower end part. The center part extends parallel to and contacts a corresponding one of the end surfaces 2*b* and 2*c*. The upper end part and the lower end part are bent from the center part perpendicularly to the end surfaces 2*b* and 2*c* and are separated from the thermistor block 2 respectively by the upper and lower insulating layers 5*a* and 5*b* which are inserted in between. Thus, the outer electrodes 6 and 7 are not only independent (that is, they are not continuations) of the surface electrodes 3 and 4, but also contact the surface electrodes 3 and 4, respectively, only through their center parts. The underlying layers 6*a* and 7*a* comprise a conductive material which is easily bondable to the surface electrode 3 or 4 and may be selected appropriately, depending on the material for the surface electrodes 3 and 4. If the surface electrodes 3 and 4 are of a layered structure with layers of a Ni/Cr alloy and Ag, for example, the underlying layers 6*a* and 7*a* may comprise a film of a Ni/Cr alloy or Ag. The outer layers 6*b* and 7*b* may comprise a material with a better solderability (than the underlying layers 6*a* and 7*a*) such as Sn, Pb and Sn/Pb alloys.

In addition, an intermediate layer of a material which can easily adhere to the outer layers 6*b* and 7*b* such as Ni may be formed, although not illustrated, between the underlying layers 6*a* and 7*a* and the outer layers 6*b* and 7*b* for protecting the underlying layers 6*a* and 7*a*.

The resistance value of this thermistor 1 is determined by the mutually facing distance the surface electrodes 3 and 4 (defined as above) and the width of their separation. Since the surface electrodes 3 and 4 are comb-shaped, however, thermistors with various resistance values can be obtained easily by varying the widths of and the gaps between the electrode fingers 3*a* and 4*a* (or the separation distance between the mutually adjacent electrode fingers). In other words, thermistors with various resistance values can be obtained according to this invention although thermistor blocks of a same kind are used.

Another advantage of this invention is that thermistors having low resistance values can be produced without increasing their size because the surface electrodes 3 and 4 are comb-shaped and their electrode fingers 3*a* and 4*a* are inserted between each other in an interdigital formation. Still another advantage of this invention is that the surface electrodes 3 and 4 can be accurately formed because the known thin-film technology can be used and hence the variations in their resistance values can be reduced.

It is to be noted that the insulating layer 5*a* on the upper surface 2*a* of the thermistor block 2 extends to the edges to the end surfaces 2*b* and 2*c* and hence that the outer electrodes 6 and 7 do not contact the surface electrodes 3 and 4 directly. Since the outer electrodes 6 and 7 contact the surface electrodes 3 and 4 only on the end surfaces 2*b* and 2*c* of the thermistor block 2, the variations of the resistance values due to inaccuracy in the shape of the outer electrodes 6 and 7 are also reduced.

The surface electrodes 3 and 4 can be formed accurately by photolithography if their film thickness is as small as 0.1–2 $\mu$m. If their thickness exceeds 2 $\mu$m, it may not be possible to form them by photolithography with a high degree of accuracy. If the thickness is less than 0.1 $\mu$m, it is too thin and the reliability as electrode may be adversely affected.

Figure 2A:
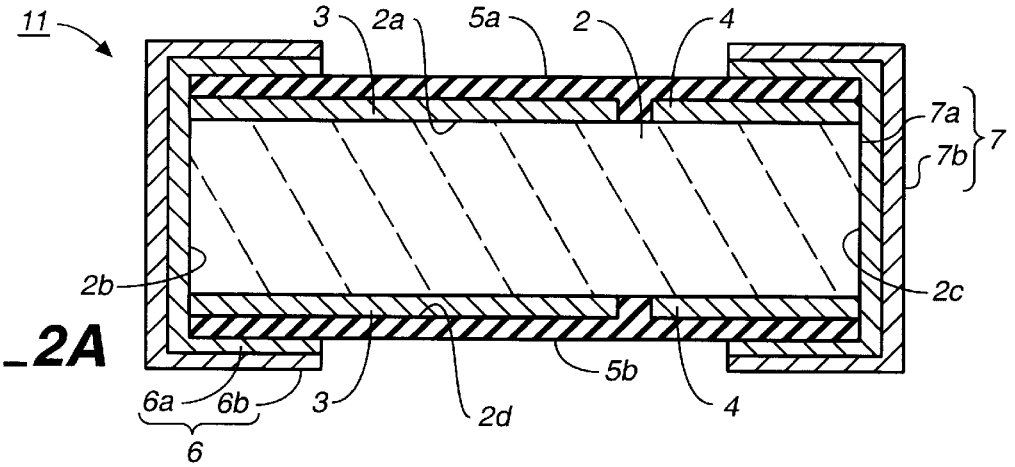
FIG. 2A is a sectional side view of another chip-type thermistor according to a second embodiment of this invention and FIG. 2B is a plan view of a pair of its surface electrodes.
Figure 2B:
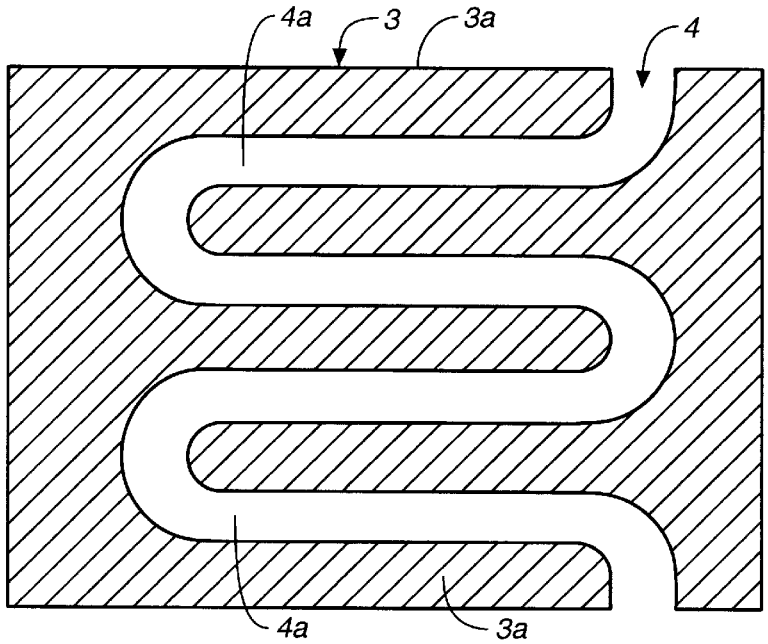

FIGS. 2A and 2B show another chip-type thermistor 11 according to a second embodiment of this invention, which is similar to the thermistor 1 according to the first embodiment of the invention, described above with reference to FIGS. 1A and 1B, but is different therefrom only wherein surface electrodes 3 and 4 are also formed on the bottom surface 2*d* of the thermistor block 2. In other words, both the upper surface 2*a* and the bottom surface 2*d* of the thermistor block 2 have a pair of surface electrodes 3 and 4 formed thereon and insulating layers 5*a* and 5*b* are formed to cover these surface electrodes 3 and 4.

The surface electrodes 3 and 4 are comb-shaped as shown in FIG. 2B, having a plurality of electrode fingers 3*a* and 4*a* protruding toward each other and sandwiching each other in an interdigital form. Because of the comb-like shape of the surface electrodes 3 and 4, thermistors according to the second embodiment of the invention enjoy also the same advantages explained above with reference to the thermistor 1 according to the first embodiment of the invention. Since another pair of comb-like surface electrodes 3 and 4 is formed additionally on the bottom surface 2*d* of the thermistor block 2, thermistors of even lower resistance values can thus be obtained.

Figure 3A:
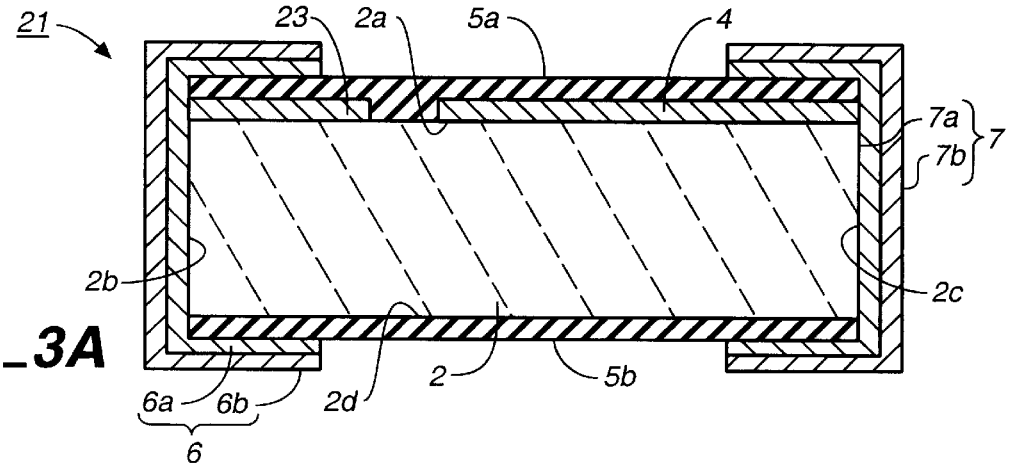
FIGS. 3A and 3B are respectively a sectional side view and a plan view of still another chip-type thermistor according to a third embodiment of this invention.
Figure 3B:
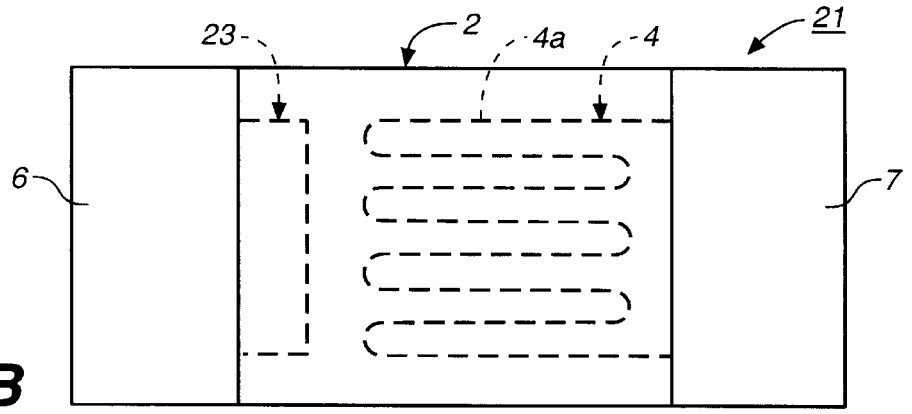

FIGS. 3A and 3B show still another chip-type thermistor 21 according to a third embodiment of this invention, which is similar to the thermistor 1 according to the first embodiment of the invention, described above with reference to FIGS. 1A and 1B, but is different therefrom wherein one of the pair of comb-shaped surface electrodes 3 of the thermistor 1 according to the first embodiment is replaced by a rectangular electrode 23, the other surface electrode 4 being comb-shaped and having electrode fingers 4*a* protruding towards the rectangular surface electrode 23. According to this embodiment of the invention, too, thermistors with various resistance values can be formed by using thermistor blocks 2 of a same shape because the number, width and/or length of the electrode fingers 4*a* of the comb-shaped surface electrode 4 can be easily adjusted.

Figure 4A:
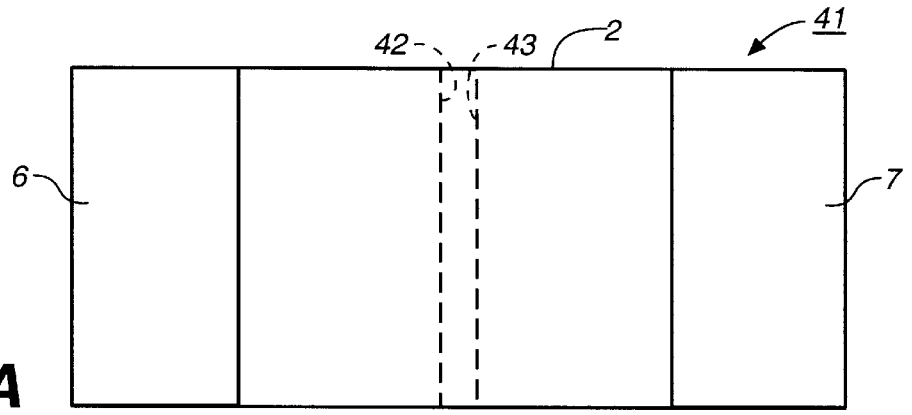
FIGS. 4A, 4B and 4C are bottom views of still other chip-type thermistors of this invention with surface electrodes formed on the bottom surface of a thermistor block.

In addition to the surface electrodes 3 and 4 on the upper surface 2*a* of the thermistor block 2 of the thermistor 1, surface electrodes of various shapes may be formed on the bottom surface of the thermistor block 2 so as to obtain a lower resistance value. FIG. 4A shows a chip-type thermistor 41 having two rectangular surface electrodes 42 and 43 formed on the bottom surface of a thermistor block 2 so as to face each other at a center region of the bottom surface and to be electrically connected respectively to the outer electrodes 6 and 7 on the end surfaces of the thermistor block 2. Although FIG. 4A shows an embodiment with the bottom surface electrodes 42 and 43 spanning the entire width of the bottom surface of the thermistor block 2, they are not required to so extend, nor are they required to face each other at the center of the bottom surface. As long as they overlap partially with the surface electrodes on the upper surface of the thermistor block 2, as seen in the vertical direction, they may be of any reasonable shape.

Figure 4B:
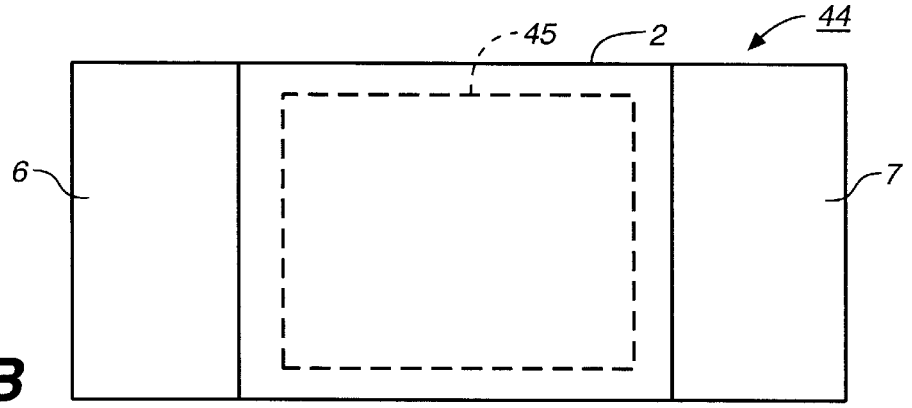
Figure 4C:
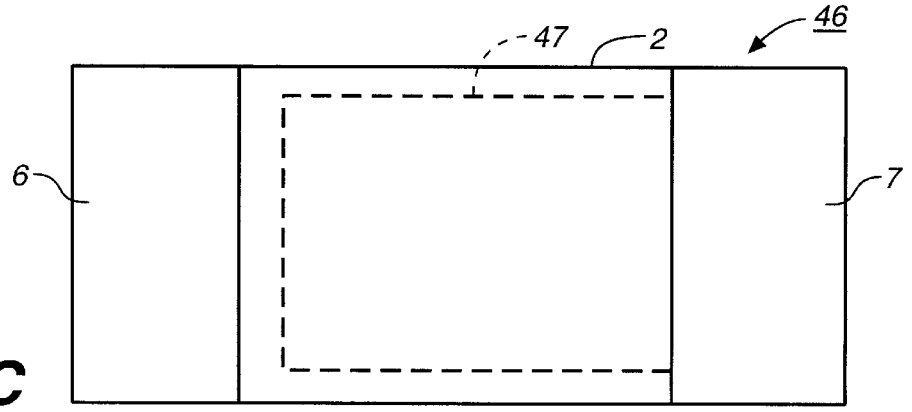

FIG. 4B shows another chip-type thermistor 44 characterized as having a floating electrode 45 on the bottom surface of the thermistor block 2. The floating electrode 45 is formed so as not to contact electrically either of the outer electrodes 6 and 7. FIG. 4C shows still another chip-type thermistor 46 having a surface electrode 47 formed on the bottom surface of the thermistor block 2 so as to be electrically contacted with only one of the outer electrodes (7).

Figure 1C:
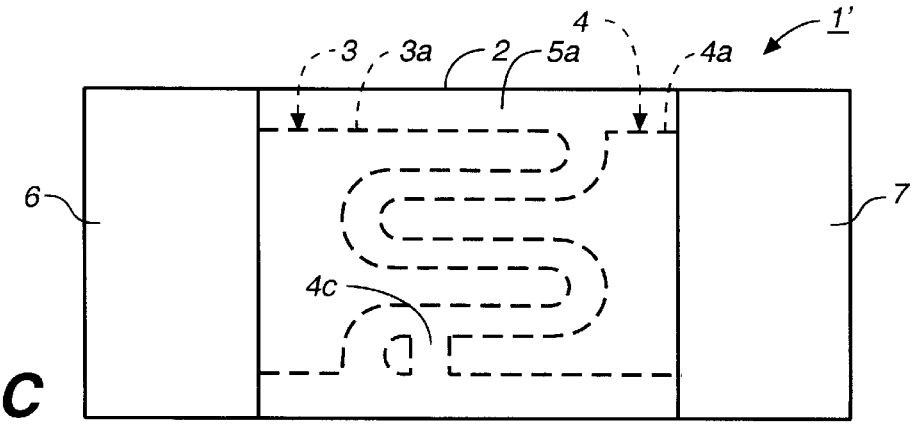
FIG. 1C is a plan view after a portion of one of the electrode fingers is removed according to an embodiment of this invention.

In order to improve the accuracy associated with the formation of the surface electrodes 3 and 4, say, of the thermistor 1 shown in FIGS. 1A and 1B, the present invention also teaches the method of removing a portion of an electrode finger of one of the surface electrodes. FIG. 1C shows a thermistor 1' thus obtained from the thermistor 1 of FIGS. 1A and 1B by introducing a removed portion (gap) 4*c* in one of the electrode fingers 4*a*. This removed portion 4*c* is removed such that the resistance value of the thermistor 1' will fall within the allowable range of its target resistance value.

The invention does not impose any particular limitation on the method of removing a portion of an electrode finger 4*a* to provide a removed portion 4*c*. The removal may be effected after the surface electrodes 3 and 4 are formed as shown in FIG. 1B by laser trimming, sand blasting or etching.

Figure 5A:
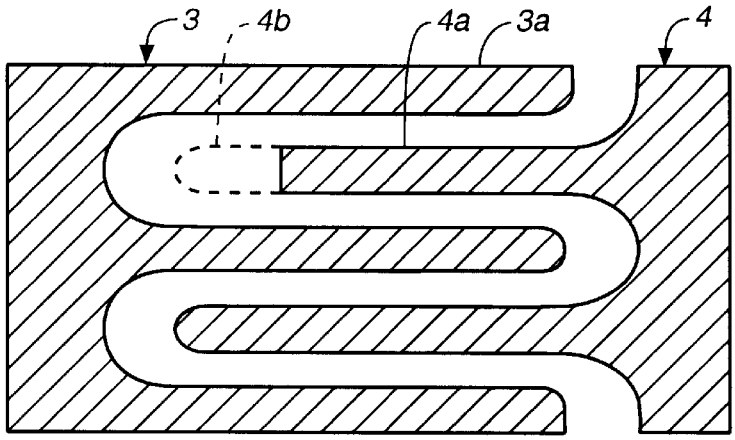
FIGS. 5A and 5B are plan views of other surface electrodes.
Figure 5B:
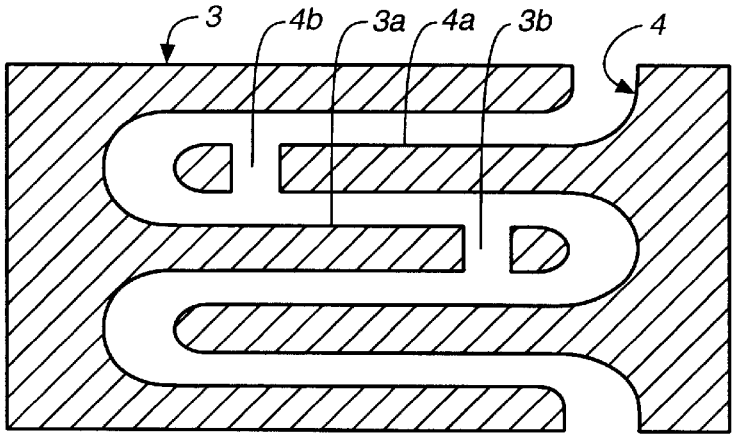

The removal process, as described above, need not be effected exactly as shown in FIG. 1C. A removed portion (gap) may be provided to an electrode finger 3*a* of the other of the pair of surface electrodes (3), although not separately illustrated. As shown in FIG. 5A, a tip portion 4*b* of one of the electrode fingers 4*a* may be removed by effectively reducing the length of the electrode finger. Alternatively, as shown in FIG. 5B, a portion (3*b* and 4*b*) may be removed from each of the electrode fingers 3*a* and 4*a*.

There will be described next the process by which thermistors 1 and 1' described above were produced.

Figure 6A:
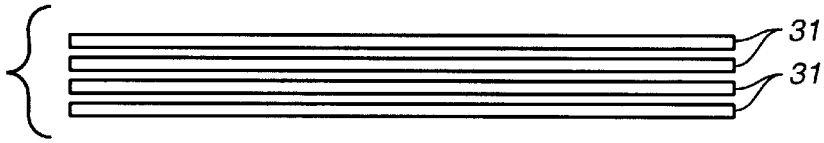
FIGS. 6A, 6B, 6C and 6D are side views showing initial steps of a process for producing thermistors according to the first embodiment of this invention.
Figure 6B:
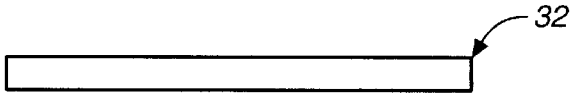
Figure 6C:
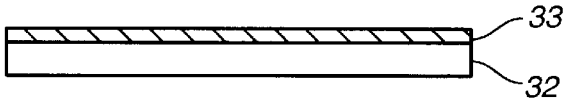

First, Mn compounds, Ni compounds and Co compounds were mixed together with a binder to make a slurry, and a sheet was obtained therefrom by a doctor blade method. It was cut into rectangular planar green sheets of 65×65 mm. As shown in FIG. 6A, a plurality of such green sheets 31 were piled up one on top of another. After they were pressed together, they were subjected to a firing process at 1300° C. for one hour to obtain a thermistor wafer 32 of 50×50×0.5 mm as shown in FIG. 6B. Next, a film of a Ni/Cu alloy and a film of Ag, each with thickness 0.5 μm, were sequentially formed by sputtering all over the upper surface of the wafer 32 to obtain an electrode layer 33 as shown in FIG. 6C.

The electrode layer 33 is what eventually becomes surface electrodes and is preferably of a material which can make an ohmic contact with a thermistor block, is mechanically strong against peeling and is easy to work with. This electrode layer 33 may be formed by a screen printing method but the vacuum vapor deposition method is preferable in view of the photolithography method to be used later because a uniform film thickness less than several μm can be obtained.

Figure 6D:
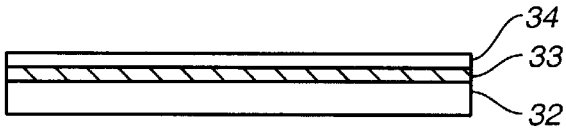
Figure 7A:
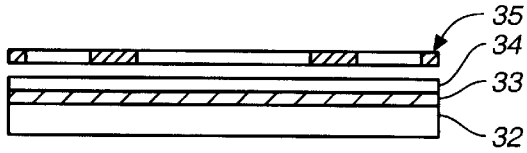
FIG. 7A is a side view showing a subsequent step in the process and FIG. 7B is a plan view of the mask.
Figure 7B:
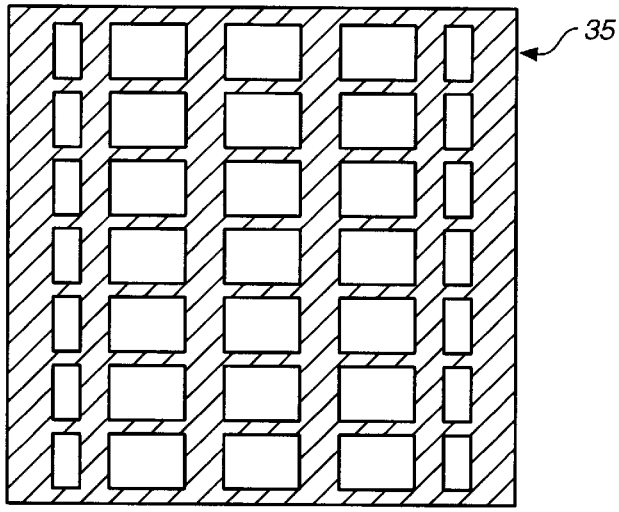
Figure 8A:
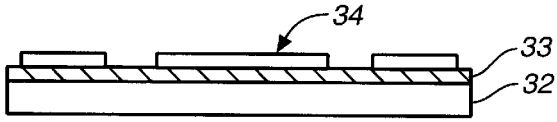
FIGS. 8A, 8B and 8C are side views of the wafer of FIGS. 6D during the steps subsequent to the step shown in FIG. 7A
Figure 8B:
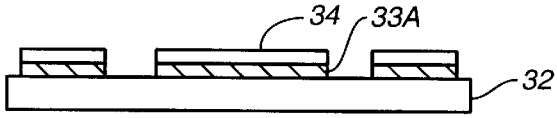

Thereafter, a photoresist material was applied on the electrode layer 33 by spin coating to form a photoresist layer 34 of thickness 1 μm, as shown in FIG. 6D. Next, as shown in FIG. 7A, a mask 35 with a specified shape such as shown in FIG. 7B was placed on the photoresist layer 34 and it was exposed to light. After the exposure to the light, it was developed by using a solvent to form a pattern in the photoresist layer 34, as shown in FIG. 8A. Next, the parts of the electrode layer 33 not covered by the photoresist layer 33 were etched in the order of the Ag film and then the Ni/Cr film to form a pattern in the electrode layer 33, as shown in FIG. 8B.

Figure 8C:
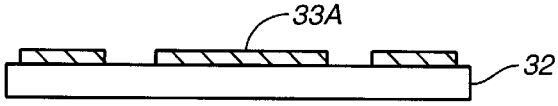
Figure 8D:
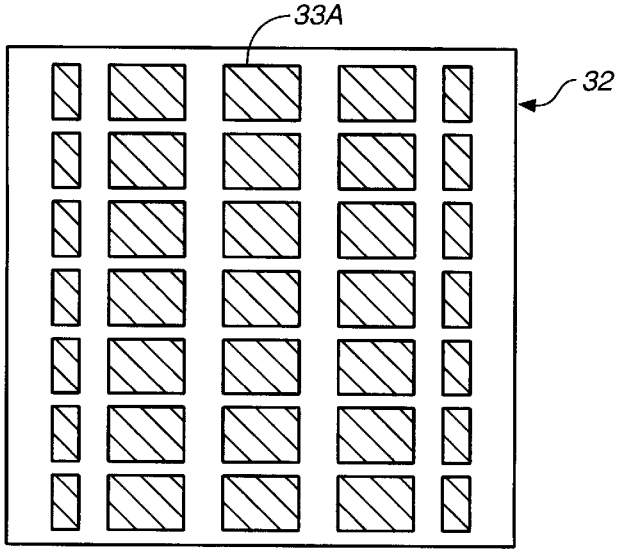
FIG. 8D is a plan view of the wafer shown in FIG. 8C.

Next, the remaining part of the photoresist layer 34 on the patterned electrode layer 33 was removed by means of a solvent to obtain a patterned electrode layer 33A as shown in FIGS. 8C and 8D. The patterned electrode layer 33A has the shape of the surface electrodes of many thermistor elements gathered together (say, in rows and columns). The gap between mutually opposite pair of surface electrodes corresponding to each thermistor element was set equal to 100 μm. The accuracy in the resistance value of a thermistor depends largely on the separation between the surface electrodes. In view of the accuracy of the photolithography process and the desired resistance value to be obtained, the separation distance is preferably from several tens to several hundred mμ, and more preferably in the range of 10–200 μm. For the same reason, the width of the electrode fingers of the comb-shaped electrodes is preferably in the range of 10–100 μm.

During the patterning processes described above, the number of electrode fingers on the comb-shaped electrodes can be increased or decreased to easily adjust the resistance value. In view of the above, resistance values of various thermistor element areas of the wafer 32 were measured. In other words, the distribution of resistance values inside the wafer 32 was measured by contacting terminals of an instrument for measuring resistance. In order to determine such a resistance distribution, the measurements were carried at twenty randomly selected positions.

Figure 9A:
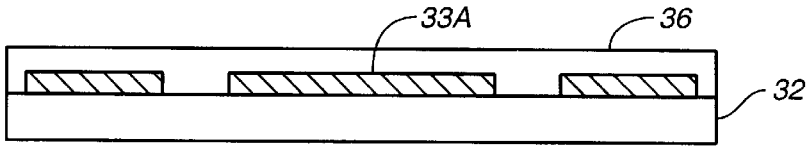
FIGS. 9A, 9B, 9C, 9D and 9E are side views of the wafer of FIGS. 8C and 8D undergoing subsequent steps of the production process.
Figure 9B:
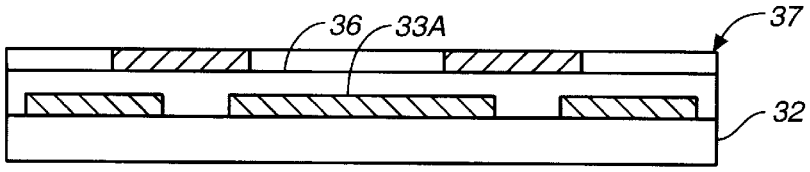
Figure 9C:
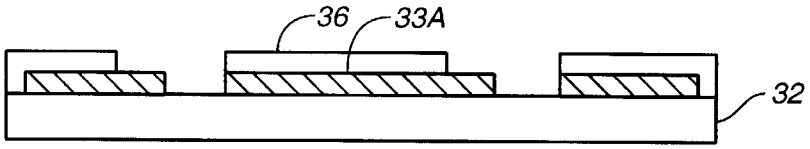
Figure 9D:
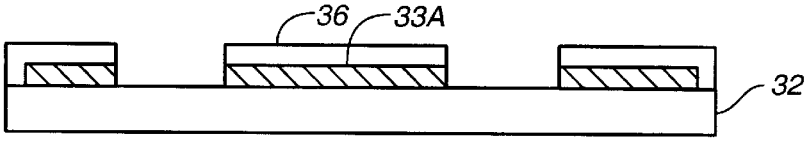
Figure 9E:
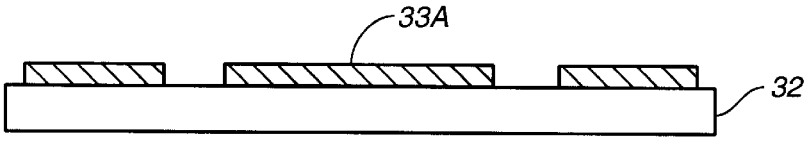

With some of the thermistor elements (1'), a tip part of an electrode finger of a comb-shaped electrode was removed to adjust the resistance value on the basis of the measured resistance distribution. This partial removal of an electrode finger was carried out by a photo-litho-etching method by first applying a photoresist 36 over the patterned electrode layer 33A as shown in FIG. 9A, placing a mask 37 thereon as shown in FIG. 9B, and exposing it to light. If the photoresist 36 is of a positive type, the mask 37 is of the type with openings where the surface electrode is to be removed. If the photoresist 36 is of a negative type, the mask 37 is of the type with openings other than where the surface electrode is to be removed. After the exposure to light, the parts of the photoresist 36 above the areas of the electrode layer 13A to be removed were removed as shown in FIG. 9C by using a solvent for development. Thereafter, an acid was used to etch away the parts of the electrode layer 13A intended to be removed, as shown in FIG. 9D, and the remaining photoresist 36 was then removed by a solvent, as shown in FIG. 9E.

Figure 10A:
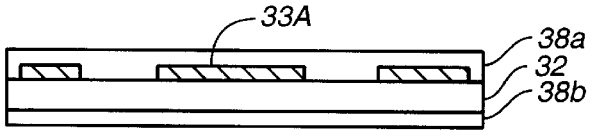
FIGS. 10A and 10B are respectively a side view and a plan view of the wafer of FIG. 9D after a spin coating process.
Figure 10B:
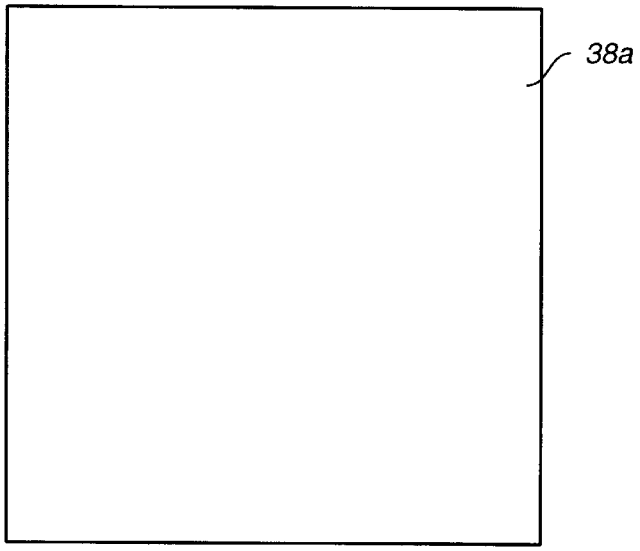
Figure 11A:
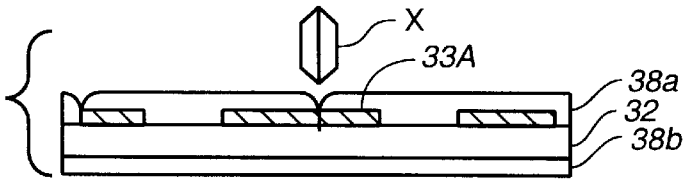
FIGS. 11A and 11B are respectively a side view and a plan view of the wafer of FIGS. 10A and 10B being cut into individual elements.
Figure 11B:
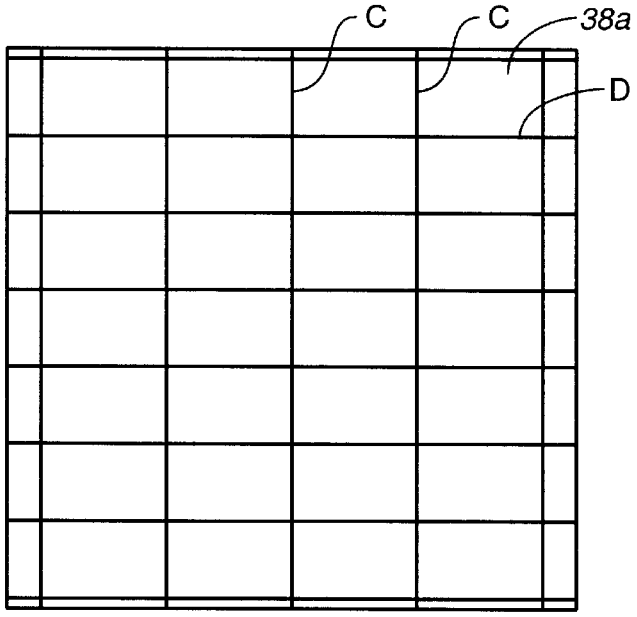

Next, as shown in FIGS. 10A and 10B, polyimide layers 38*a* and 38*b* of thickness 4 μm were formed on the upper and bottom surfaces of the wafer 32 by spin coating. Thereafter, as shown in FIGS. 11A and 11B, the wafer 32 was cut along parallel planes C and D by forming elongated cuts both in longitudinal and transverse directions on the surface of the wafer by means of a scriber such as a diamond blade X applied with a pressure of 9.8N. The scribing step may be carried out before the polyimide layers 38*a* and 38*b* are formed.

Figure 12A:
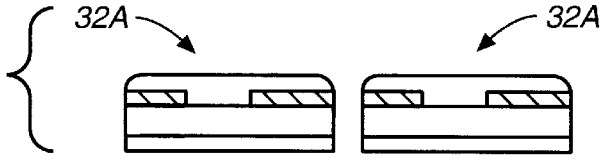
FIGS. 12A and 12B are respectively a side view and a plan view of the wafer sticks into which the wafer shown in FIGS. 11A and 11B is cut.
Figure 12B:
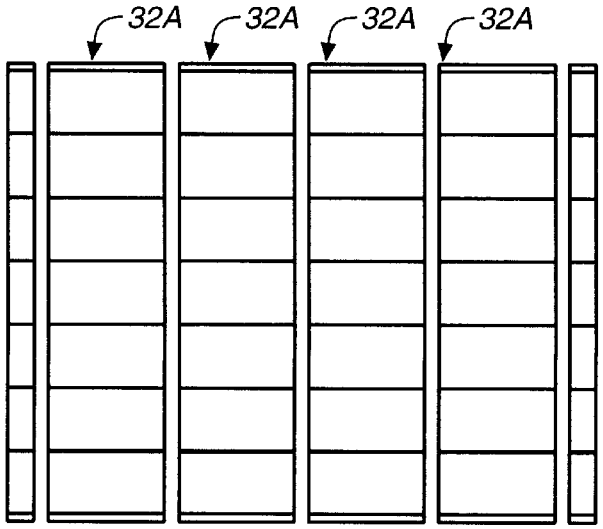

Thereafter, the wafer 32 was broken into wafer sticks 32A as shown in FIGS. 12A and 12B by using a hard rubber roller to apply a force in the direction of the thickness of the wafer 32 along the lines C. The width of the stick-shaped wafer divisions 32A was made equal to the width in the longitudinal direction of the thermistors 1 to be finally obtained. In other words, each wafer stick 32A consists of a single row of mutually connected individual thermistor elements.

Figure 13A:
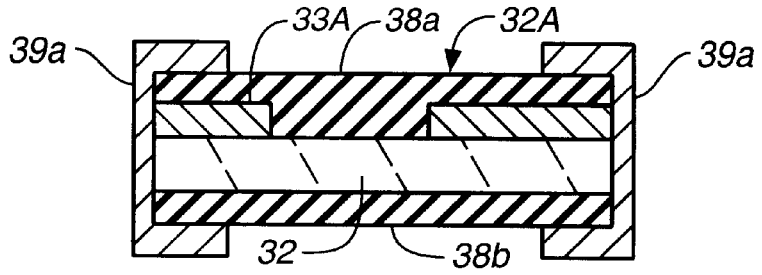
FIGS. 13A and 13B are side views of a wafer stick during different stages of a process for making thermistor elements of this invention.
Figure 13B:
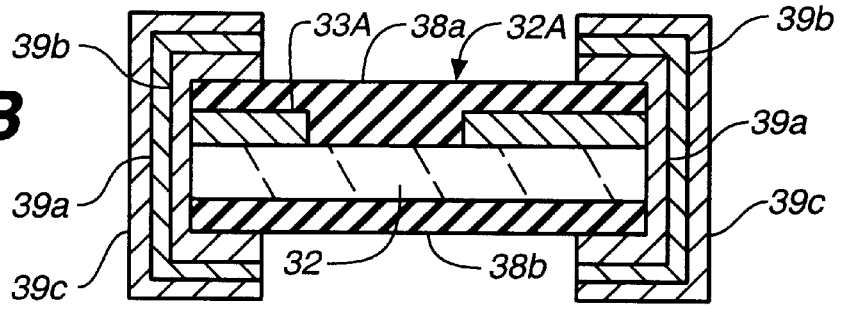

Next, layered films of Ni/Cr alloy and Ag 39*a* each of thickness 1 μm were formed on both side surfaces of each wafer stick 32A thus obtained as shown in FIG. 13A. Thereafter, a Ni film 39*b* and a Sn film 39*c*, each of thickness 2 μm, were formed in this order, as shown in FIG. 13B, by a wet electrolytic plating method on each of the layered films 39*a*, as shown in FIG. 13B. There are methods whereby underlying electrodes are formed by printing or dipping but these methods have the disadvantage of making the underlying electrodes too thick. Since there are already outer electrodes, the next step of breaking up the wafer stick tends to become difficult to carry out. For this reason, underlying electrodes must be made as thin as possible while having a sufficient ohmic characteristic and strength against peeling. Thus, methods by sputtering or vapor deposition are preferable. From the point of view of forming a plated upper layer electrode on an underlying electrode, it is preferable to form the underlying electrode with a metal such as Ag or Au that has a high electrical conductivity and does not oxidize in air. If the underlying electrode is made of a metal such as a Ni/Cr alloy that oxidizes easily, it is preferable to provide a layer of Ag or Au thereabove.

Figure 14:
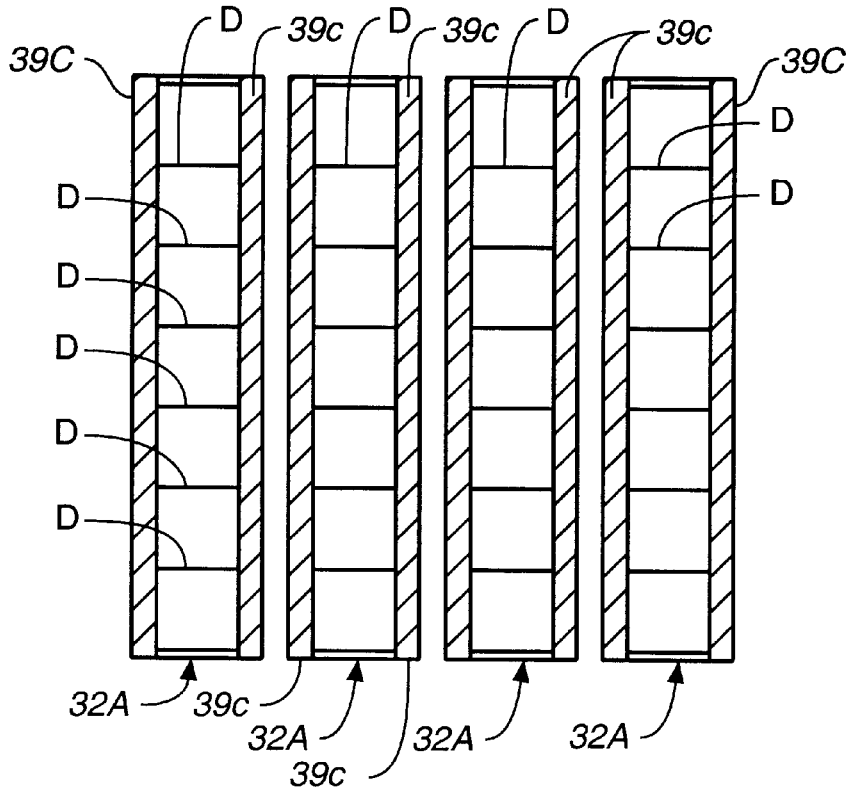
FIG. 14 is a plan view of wafer sticks before they are broken into individual thermistors.
Figure 15:
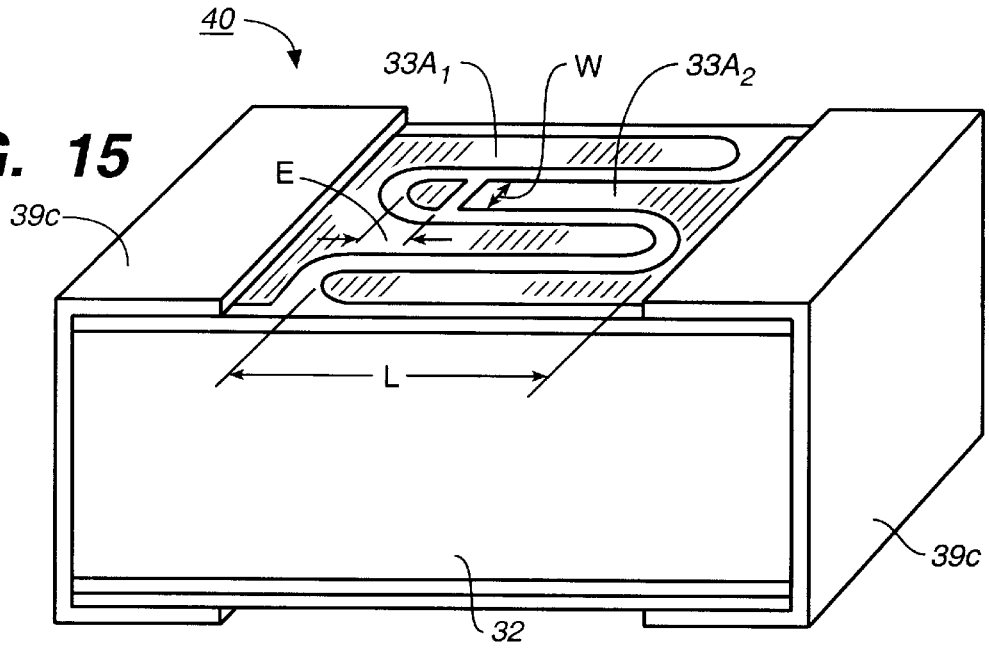
FIG. 15 is a diagonal view of a chip-type thermistor element of this invention.
Figure 16:
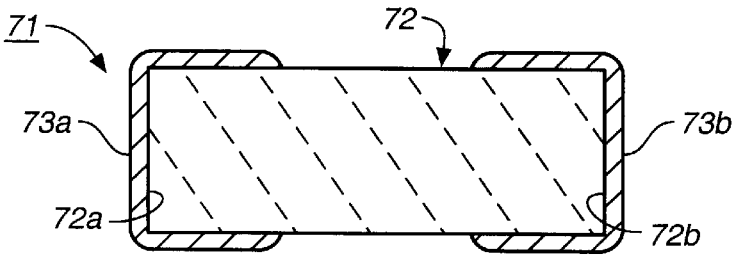
FIG. 16 (PRIOR ART)
FIG. 16 is a sectional side view of a prior art chip-type thermistor.
Figure 17:
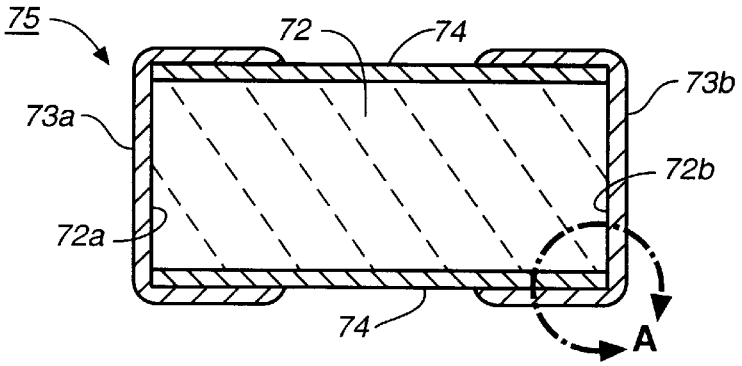
FIG. 17 (PRIOR ART)
FIG. 17 is a sectional side view of another prior art chip-type thermistor.
Figure 17A:
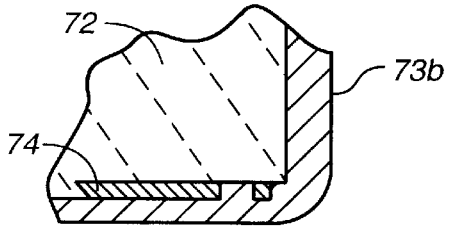
FIG. 17A (PRIOR ART)
Figure 18A:
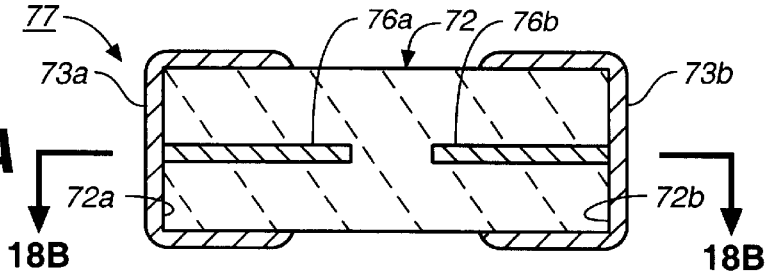
FIG. 18A (PRIOR ART)
FIG. 18A is a sectional side view of still another prior art chip-type thermistor.
Figure 18B:
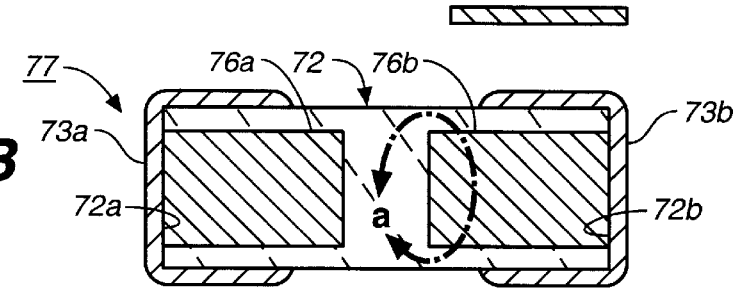
FIG. 18B (PRIOR ART)
FIG. 18B is a sectional plan view of the same chip-type thermistor taken along line 18B—18B of FIG. 18A and FIG. 18Ba is an enlarged view of the elliptical region "a" of FIG. 18B.
Figure 19A:
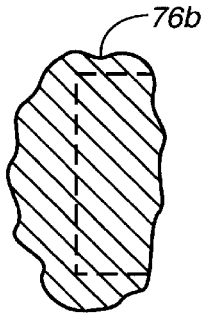
FIG. 19A (PRIOR ART)
FIG. 19A is a plan view of still another prior art chip-like thermistor.
Figure 19A:
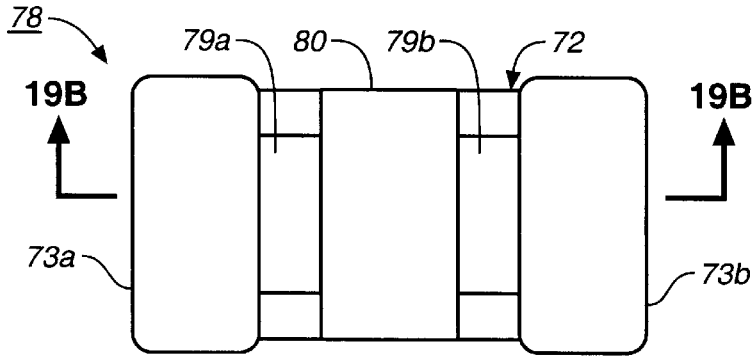
FIG. 19A (PRIOR ART)
Figure 19B:
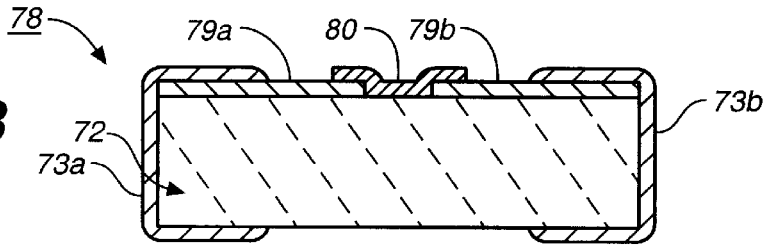
FIG. 19B (PRIOR ART)
FIG. 19B is a sectional side view of the same chip-type thermistor taken along line 19B—19B of FIG. 19A.

Next, the wafer sticks 32A are broken up along lines D as shown in FIG. 14 to obtain many thermistor elements 40, one of which is shown in FIG. 15 wherein the surface electrodes formed from the aforementioned electrode layer 33A are indicated by symbols $\mathbf{33}A_1$ and $\mathbf{33}A_2$.

As a part of experiments for studying the effects of the invention, four kinds of chip-type thermistors 1 were prepared by using different masks 35 to vary the number, length and width of the electrode fingers of the surface electrodes, as well as the separation between the pair of surface electrodes, and their resistance values and their variations were measured. The specific resistance of the material for the thermistor blocks 2 used for making these chip-type thermistors 1 was 2 kΩcm at 25° C. and their dimensions were 1.6×0.8×0.8 mm. For the purpose of comparison, the same thermistor blocks were used to produce prior art thermistors shown at 71, 75, 77 and 78 in FIGS. 16–19, and their resistance values and their variations 3 CV (%) were measured. The results are shown in Table 1. The resistance values shown in Table 1 are average values for sample number n=100 and the variations 3 CV are the results of measured variations for sample number n=100.

TABLE 1

| | Descriptions | Resistance (kΩ) | Variation 3CV (%) |
|---|---|---|---|
| Prior art thermistor 71 | | 34.3 | 20.5 |
| Prior art thermistor 75 | | 49.6 | 8.7 |
| Prior art thermistor 77 | One sheet of inner electrode; Separation of electrodes = 200 μm | 20.3 | 9.8 |
| Prior art thermistor 78 | Separation between opposite electrodes = 500 μm | 21.2 | 6.5 |
| Examples | Comb electrodes: | | |
| | Number = 8<br>Length = 1.2 mm<br>Width = 25 μm<br>Separation = 50 μm | 2.5 | 1.6 |
| | Comb electrodes: | | |
| | Number = 5<br>Length = 1.2 mm<br>Width = 40 μm<br>Separation = 100 μm | 6.8 | 0.8 |
| | Comb electrodes: | | |
| | Number = 5<br>Length= 0.2 mm<br>Width = 40 μm<br>Separation = 100 μm | 22.1 | 1.0 |
| | Comb electrodes: | | |
| | Number = 3<br>Length = 0.2 mm<br>Width = 50 μm<br>Separation = 150 μm | 33.2 | 1.5 |

Table 1 clearly shows that thermistors 1 with very different resistance values (from 2.5 to 33.2 kΩ) can be obtained merely by changing the number, length and width of the electrode fingers of the surface electrodes as well as the separation between the pair of surface electrodes. It also shows that the variations (3 CV) in the resistance values are no greater than 1.6%, although the variations are quite large among the prior art thermistors.

As another part of the experiments for studying the effects of the invention, masks 17 with different shapes were used on chip-thermistors obtained as above to change the length of the removed portion of an electrode finger of a surface electrode. The results of this study are summarized in Table 2. In Table 2, "removed length" means the length indicated by double-headed arrow E in FIG. 15. For the purpose of this experiment, thermistors were produced with three fingers protruding from the surface electrode $\mathbf{33}A_1$ and two fingers protruding from the surface electrode $\mathbf{33}A_2$, each having width W of 0.040 mm and length (before the "removal") L of 1.200 mm.

TABLE 2

| Correction in Resistance Value (%) | Removed Length (mm) |
|---|---|
| +0.5 | 0.017 |
| +1.0 | 0.034 |
| +1.5 | 0.051 |
| +2.0 | 0.068 |
| +2.5 | 0.085 |

As shown in Table 2, the resistance value could be changed within a range of 0.5% to 2.5% by changing the length of the portion of an electrode finger to be removed from 0.017 mm to 0.085 mm. In other words, thermistors of a kind shown at 40 in FIG. 15 and having resistance values within a specified allowable range can be dependably produced by forming a patterned electrode layer 33A, thereafter measuring the resistance values between the surface electrodes of individual thermistor element parts, comparing the measured values with the target value and then removing portions of the electrode fingers of the individual thermistor element parts according to the differences between the measured values and the target value. According to a practical method, a table showing the relationship between the correction in the resistance value and the removed length of the electrode finger is preliminarily prepared by carrying out measurements. When thermistors are produced, their actual resistance values are measured and required correction values are obtained from such measured values by using this prepared relationship. If the device for making these measurements and the device for removing a portion of an electrode finger are controlled together, the correction operations can be carried out more efficiently.

The invention has been described above with reference to only a limited number of examples, but these examples are not intended to limit the scope of the invention. Many modifications and variations are possible within the scope of this invention. For example, the removal of a portion of an electrode finger need not necessarily be carried out by a method of photolithography but may be done by using a laser. When a laser is used for the purpose of this invention, the laser beam may be used to burn off the portion of the electrode finger to be removed, or alternatively to oxidize a portion of the electrode finger by the laser energy so as to remove the ohmic contact between that portion of the surface electrode and the thermistor block. In other words, expressions like "partial removal" or "partially removing" are intended to refer to an operation whereby the original function of the surface electrode is lost, not necessarily to a physical removal, and this includes situations where the affected part of the electrode becomes insulative. The removal of a potion of a surface electrode may be effected likewise by a sand-blasting method.

When specified parts of surface electrodes are removed, this trimming operation may be carried out on the wafer or after the wafer has been divided into individual thermistor elements. After the insulating layer above the surface electrodes is destroyed by such a trimming operation, it may be left as such or the destroyed portions may be repaired by coating with an insulating material.

Although the disclosure is intended to be generally interpreted broadly, expressions like "comb electrodes" and "comb-shaped electrodes" should be interpreted as referring to an electrode having a shape which can be practically described as that of a comb, having a set of elongated solid members (fingers) of substantially the same lengths protruding substantially in the same direction.

What is claimed is:

1. A chip thermistor comprising:

a thermistor block having end surfaces extending between an upper surface and a lower surface which face away from each other;

a pair of surface electrodes facing each other on said upper surface of said thermistor block, at least one of said surface electrodes being comb-shaped, having electrode fingers protruding towards the other of said surface electrodes;

an insulating layer on said upper surface of said thermistor block, said insulating layer covering said pair of surface electrodes and extending to said end surfaces of said thermistor block; and a pair of outer electrodes which are each on a corresponding one of said end surfaces and in direct contact with said thermistor block, each of said outer electrodes having a center part, an upper end part and a lower end part, said center part extending parallel to said end surfaces, said upper end part and said lower end part being bent from said center part and extending perpendicularly to said end surfaces, said insulating layer being between each of said surface electrodes and the upper part of a corresponding one of said outer electrodes, said outer electrodes each being electrically connected to an associated one of said surface electrodes only through said center part.

2. The chip thermistor of claim 1 wherein each of said pair of surface electrodes is comb-shaped, having electrode fingers protruding towards the other of said surface electrodes, and is of thickness 0.1–2 $\mu$m.

3. The chip thermistor of claim 1 wherein said insulating layer comprises a heat-resistant resin with temperature of thermal deformation over 150° C.

4. A chip thermistor comprising:

a thermistor block having mutually oppositely facing end surfaces extending between an upper surface and a lower surface which face away from each other;

a pair of surface electrodes facing each other on said upper surface of said thermistor block, at least one of said surface electrodes being comb-shaped, having electrode fingers protruding towards the other of said surface electrodes;

an insulating layer on said upper surface of said thermistor block, said insulating layer covering said pair of surface electrodes and extending to said end surfaces of said thermistor block; and a mutually separated pair of outer electrodes each on a corresponding one of said end surfaces, each of said outer electrodes having a center part, an upper part and a lower part, said center part extending parallel to said end surfaces, said upper end part and said lower end part being bent from said center part and extending perpendicularly to said end surfaces, said lower end part being separated and electrically insulated from said thermistor block, each of said outer electrodes being in direct contact with said thermistor block and electrically connected to an associated one of said surface electrodes only through said center part.

5. The chip thermistor of claim 4 wherein each of said pair of surface electrodes is comb-shaped, having electrode fingers protruding towards the other of said surface electrodes, and is of thickness 0.1–2 $\mu$m.

6. The chip thermistor of claim 4 wherein each of said outer electrodes also has an upper end part which is over and parallel to said upper surface and is in contact with said insulating layer.

7. The chip thermistor of claim 6 wherein each of said pair of surface electrodes is comb-shaped, having electrode fingers protruding towards the other of said surface electrodes, and is of thickness 0.1–2 $\mu$m.

8. The chip thermistor of claim 4 further comprising a bottom insulating layer formed over said lower surface of said thermistor block, said lower end part of each of said outer electrodes being separated from said thermistor block with said insulating layer inserted therebetween.

9. The chip thermistor of claim 8 wherein each of said pair of surface electrodes is comb-shaped, having electrode fingers protruding towards the other of said surface electrodes, and is of thickness 0.1–2 $\mu$m.

10. The chip thermistor of claim 4 wherein said insulating layer comprises a heat-resistant resin with temperature of thermal deformation over 150° C.

* * * * *